US007874617B2

(12) United States Patent
Ogle

(10) Patent No.: US 7,874,617 B2
(45) Date of Patent: Jan. 25, 2011

(54) BABY SEAT ROCKER SYSTEM

(76) Inventor: Melanie A. Ogle, 1454 Pevans Pkwy., Rapid City, SD (US) 55701

( * ) Notice: Subject to any disclaimer, the term of this patent is extended or adjusted under 35 U.S.C. 154(b) by 135 days.

(21) Appl. No.: 12/354,372

(22) Filed: Jan. 15, 2009

(65) Prior Publication Data

US 2010/0176631 A1 Jul. 15, 2010

(51) Int. Cl.
*A47C 3/02* (2006.01)

(52) U.S. Cl. ..... 297/260.2

(58) Field of Classification Search ..... 297/260.1, 297/260.2, 258.1, 217.3, 273, 330; 5/109
See application file for complete search history.

(56) References Cited

U.S. PATENT DOCUMENTS 208,052 A * 9/1878 Whitehead ..... 5/108
871,755 A * 11/1907 Flindall ..... 297/260.1
2,520,563 A * 8/1950 Preston ..... 5/109
2,765,478 A * 10/1956 Pinto ..... 5/104
3,758,156 A * 9/1973 Zawadzki ..... 297/260.2
5,615,428 A * 4/1997 Li ..... 5/109
5,711,045 A * 1/1998 Caster et al. ..... 5/109
6,574,806 B1 * 6/2003 Maher ..... 5/109
2010/0218312 A1 * 9/2010 Quintas Mendes ..... 5/109

* cited by examiner

*Primary Examiner*—Milton Nelson, Jr.
(74) *Attorney, Agent, or Firm*—Gordon & Rees LLP

(57) ABSTRACT

A rocker mechanism for a baby seat, having: a housing; a rotatable member in the housing; a drive mechanism for rotating the rotatable member; a power source for the drive mechanism; a projection on the rotatable member; a first line anchor on the housing; a second line anchor on the housing; and a line wrapped around the projection, the line having a fixed end connected to the first line anchor, a mid-portion connected to the second line anchor, and a free end, wherein the free end of the line repeatedly moves towards and away from the housing as the rotatable member rotates in the housing.

8 Claims, 4 Drawing Sheets

BABY SEAT ROCKER SYSTEM

TECHNICAL FIELD

The present invention relates to systems for rocking baby chairs and seats.

BACKGROUND OF THE INVENTION

Traditionally, babies have been rocked by hand. They can be rocked in cribs, cradles or car seats. Unfortunately, this can become quite tiring. Therefore, there is a need for an automatic rocking mechanism that rocks a baby in a car seat or a play seat. Such an automatic rocking mechanism would also have the advantage of smoothness, which is helpful in lulling a baby to sleep.

SUMMARY OF THE INVENTION

The present invention provides a rocker mechanism for a baby seat, comprising: a housing; a rotatable member in the housing; a drive mechanism for rotating the rotatable member; a power source for the drive mechanism; a projection on the rotatable member; a first line anchor on the housing; a second line anchor on the housing; and a line wrapped around the projection, the line having a fixed end connected to the first line anchor, a mid-portion passed through or around the second line anchor, and a free end, wherein the free end of the line repeatedly moves towards and away from the housing as the rotatable member rotates in the housing.

The first line anchor may optionally be a constant force spring, and the second line anchor may optionally be a pair of holes in the housing through which the line passes. The line is then wrapped around the projection. As the rotatable member moves, the distance between the projection and the second anchor repeatedly increases and then decreases. This change in distance causes the line to be repeatedly pulled back into the housing, and then released. Thus, the free end of the line moves up and down with respect to the housing. This free end can then be connected onto a baby seat, chair or crib, causing it to rock back and forth when the device is operating.

The present invention also provides a method of rocking a baby seat, comprising: attaching a first end of a line to a first stationary anchor; wrapping a portion of the line around a projection; attaching a mid-portion of the line to a second stationary anchor; attaching a second end of a line to a baby seat; and rotating the projection in a circular path, thereby causing the second end of the line to move repeatedly towards and away from the housing, thereby causing the baby seat to rock.

DETAILED DESCRIPTION OF THE DRAWINGS

The present invention provides a system for continuously rocking a baby seat, chair or crib. Specifically, a housing is provided having a line extending therefrom, and a novel mechanism in the housing causes the line to be repeatedly pulled a short distance into the housing (and then relaxed). This up and down motion of the line with respect to the housing is used to cause a baby seat, crib or chair to rock (by attaching the free end of the line to the baby seat), as follows.

Figure 1:
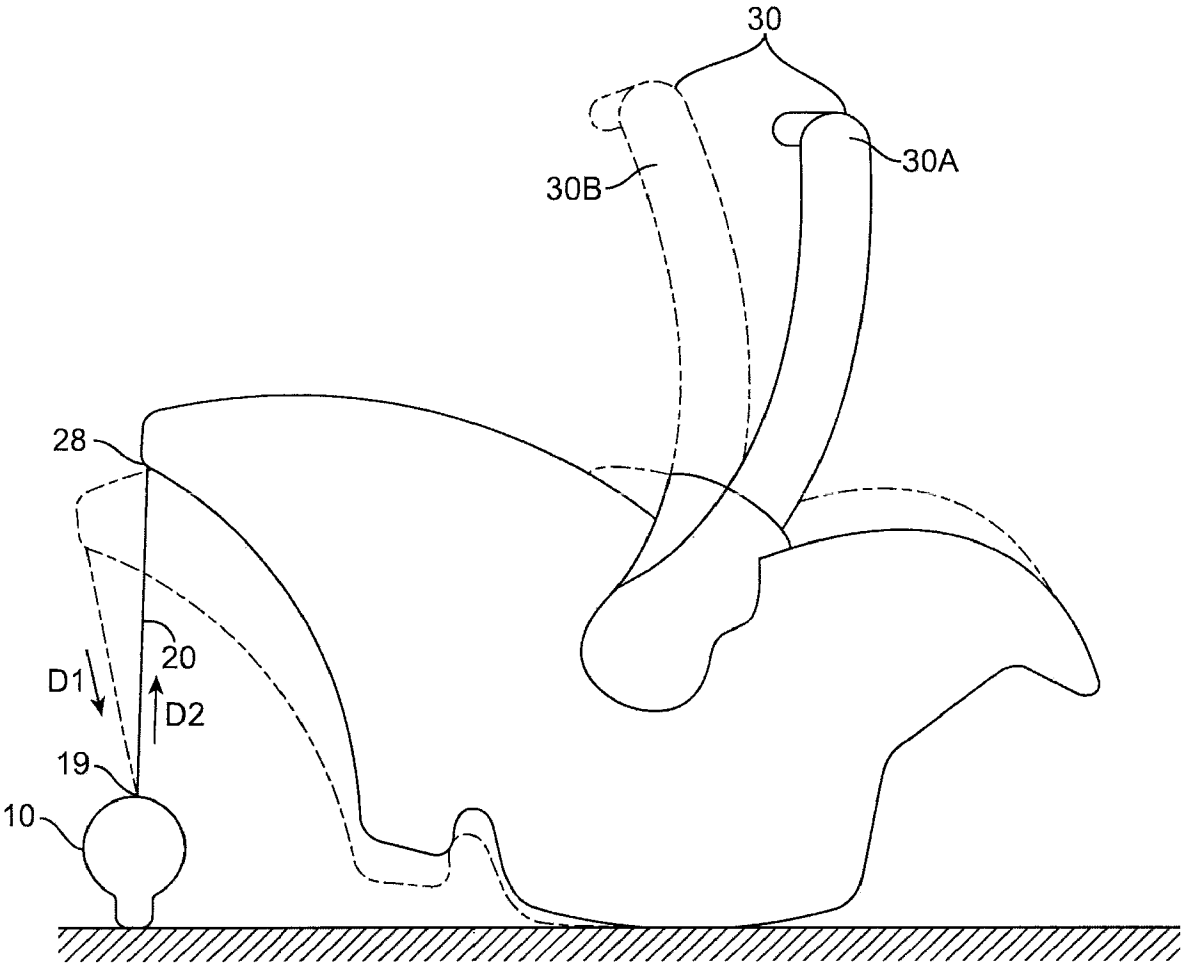
FIG. 1 is an illustration of the present system in operation.

In one aspect of the invention seen in FIG. 1, the present invention provides a rocker mechanism 10 for a baby seat 30. Rocker mechanism 10 may be mounted in a stuffed animal or form of housing. In accordance with the invention, rocker mechanism 10 has a line 20 extending therefrom. Line 20 has a free end 28 that is connected to baby seat 30. In operation, the novel rocking mechanism 10 first retracts line 20 (causing baby seat 30 to move to position 30B). Next, rocking mechanism 10 releases the tension on line 20 (causing baby seat 30 to rock back into position 30A). This process of alternating the tension on line 20 causes baby seat 30 to rock back and forth.

Figure 2:
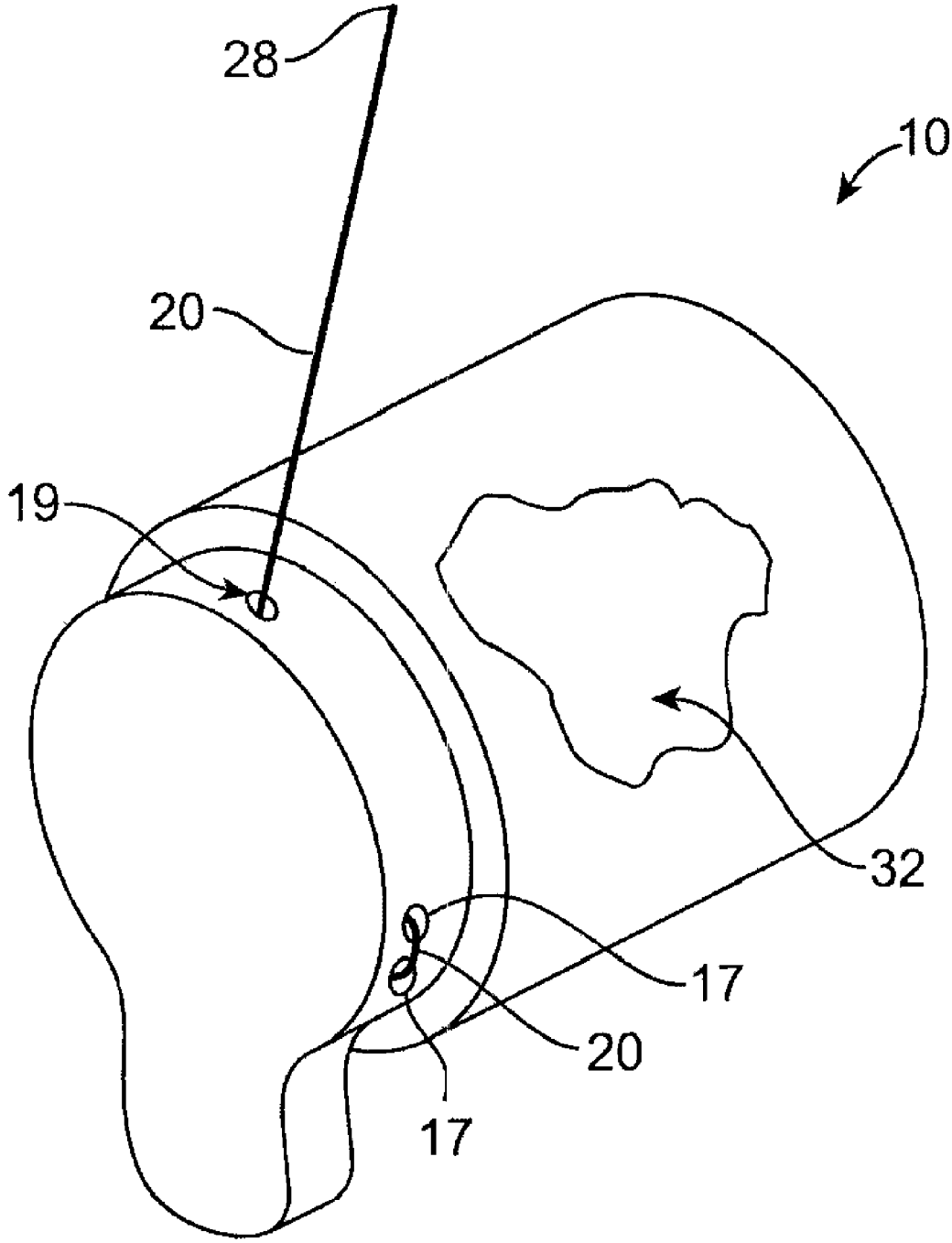
FIG. 2 is a perspective view of the housing and the line extending therefrom.

FIG. 2 is aperspective view of rocking mechanism 10, and FIGS. 3A to 3D show sequential movement of the rotatable member within the housing, illustrating how the line (to the baby chair) moves into and out of the housing, as follows.

Rocker mechanism 10 comprises: a housing 11; a rotatable member 12 in housing 11; a power source 32 for a drive mechanism 31; a drive mechanism 31 for rotating rotatable member 12; a projection 13 on rotatable member 12; a first line anchor 15 on housing 11; a second line anchor 17 on housing 11; and a line 20 wrapped around projection 13. Line 20 has a fixed end 21 connected to first line anchor 15. A mid-portion of line 20 passes through or around second line anchor 17. The free end 28 of line 20 extends out of housing 11.

Figure 3A:
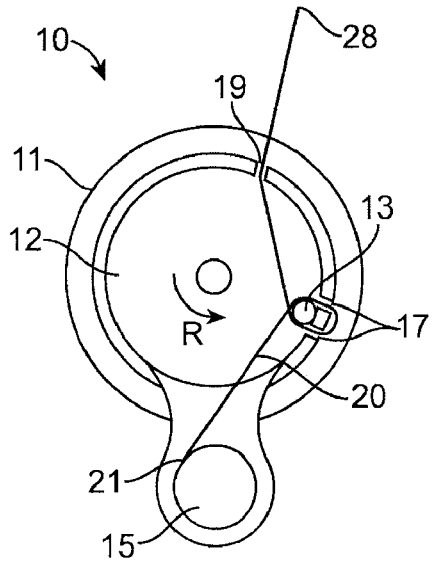
FIGS. 3A to 3D show sequential movement of the rotatable member within the housing, illustrating how the line moves into and out of the housing.
Figure 3B:
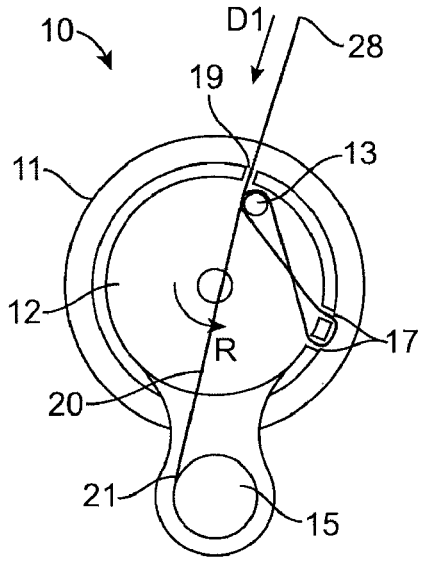
Figure 3C:
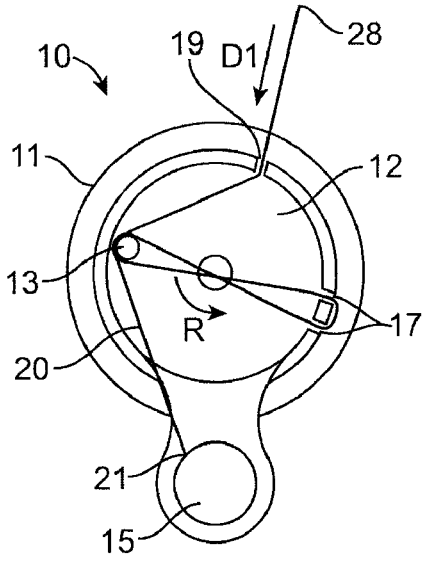
Figure 3D:
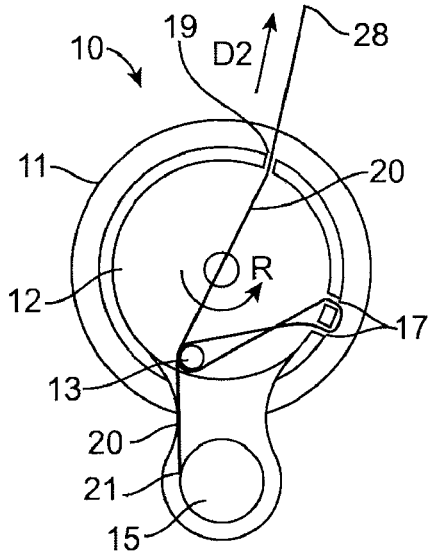

As can be see by referring to FIGS. 3A to 3D, the free end 28 of line 20 repeatedly moves towards and away from the housing as the rotatable member rotates in the housing. In other words, free end 28 moves in and out as line 20 moves in directions D1 and D2. First, as seen in FIG. 3A, line 20 has its first end 21 connected to first line anchor 15. Line 20 is wrapped around projection 13 and passes out (and back into) housing 11 through two holes which comprise second line anchor 17. Lastly, line 20 is wrapped around the opposite side of projection 13 and extends through hole 19 and passes out of housing 11. Next, as seen in FIG. 3B, rotatable member 12 has rotated in direction R to the position shown. Therefore, projection 13 has moved to a position near hole 19. As can be seen, this movement of projection 13 away from holes/anchor 17 pulls more of line 20 into housing 11, thereby causing line 20 to be pulled in direction D1. Next, as seen in FIG. 3C, rotatable member 12 has rotated further in direction R to the position shown. At this position, projection 13 has moved as far away from holes/anchor 17 as possible. As can be seen, this pulls even more of line 20 into housing 11, thereby causing line 20 to be pulled further in direction D1. Finally, as seen in FIG. 3D, rotatable member 12 has rotated further in direction R, moving projection 13 back towards holes/anchor 17. This reduces the length of line 20 that is within housing 11 and thereby allows line 20 to move back in direction D2.

Preferably, projection 15 rotates with respect to rotatable member 11. For example, projection 13 preferably rotates counterclockwise as rotatable member 11 also rotates counterclockwise. An advantage of having projection 13 free to rotate with respect to rotatable member 11 is that line 20 is not dragged across the surface of projection 15 as rotatable member 11 rotates. Rather, projection 15 turns and thus line 20 as line 20 is wrapped onto and off of projection 15 as rotatable member 11 rotates.

In optional aspects of the invention, first line anchor 15 is a constant force spring. This has the advantage of permitting system 10 to deliver a smooth rocking motion to baby seat 30 (as opposed to jarring baby seat 30 back and forth). Preferably, the spring force is greater than the force necessary to impart a rocking motion to the seat, while at the same time being less than the force necessary to overcome the weight of the entire rocking mechanism and its outer housing (e.g.: a plush toy or plastic housing).

Figure 4:
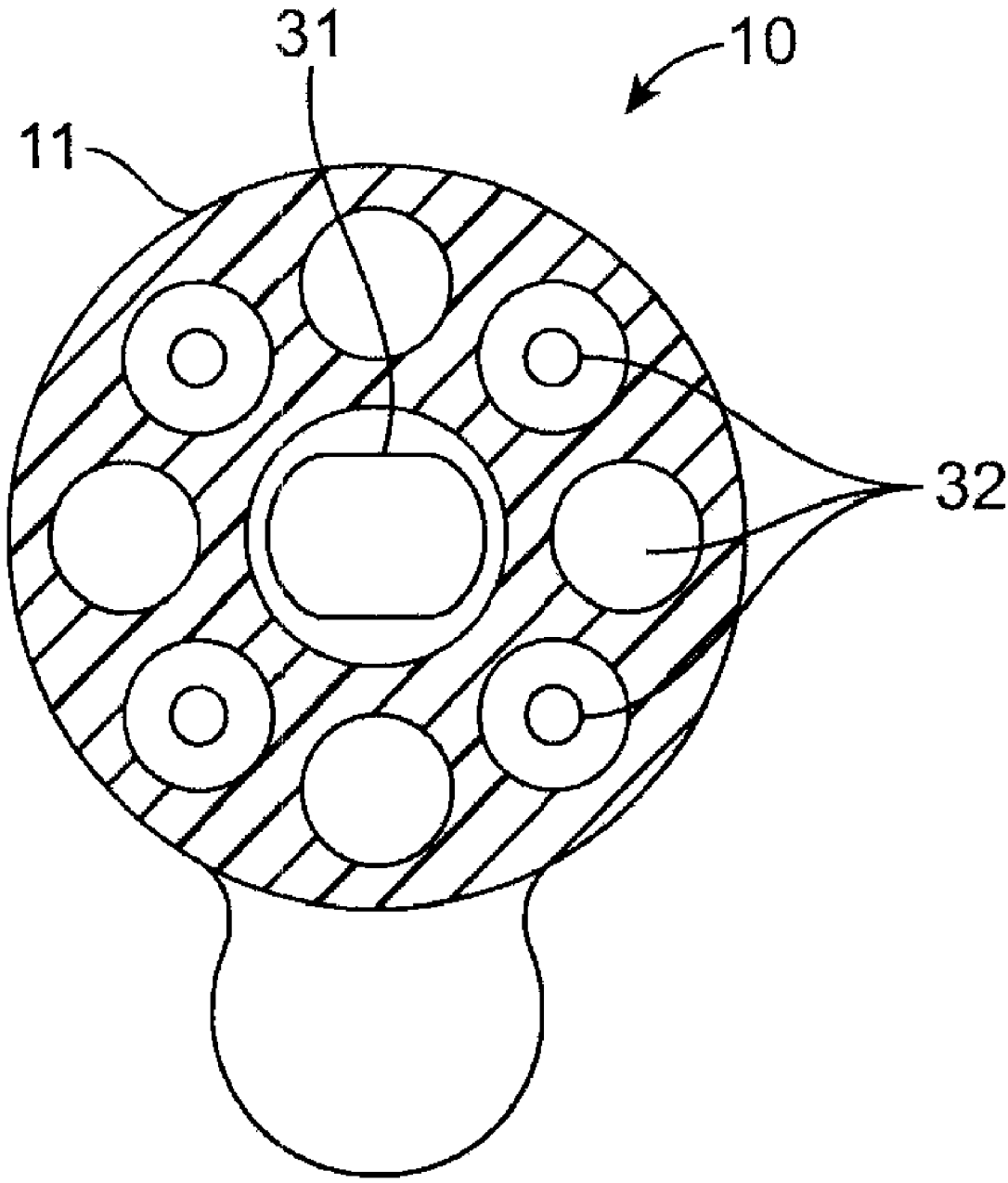
FIG. 4 is a sectional view through the housing, showing the power source.

As seen in FIGS. 1 and 4, power source 32 may be batteries. In addition, rotatable member 12 may be a rotating disk attached to a drive mechanism 31 (that is powered by batteries 32).

What is claimed is:

1. A rocker mechanism for a baby seat, comprising:

a housing;

a rotatable member in the housing;

a drive mechanism for rotating the rotatable member;

a power source for the drive mechanism;

a projection on the rotatable member;

a first line anchor on the housing;

a second line anchor on the housing; and a line wrapped around the projection, the line having a fixed end connected to the first line anchor, a mid-portion passed through or around the second line anchor, and a free end, wherein the free end of the line repeatedly moves towards and away from the housing as the rotatable member rotates in the housing.

2. The rocker mechanism for a baby seat of claim 1, wherein the power source is batteries.

3. The rocker mechanism for a baby seat of claim 1, wherein the first line anchor is a constant force spring.

4. The rocker mechanism for a baby seat of claim 1, wherein the second line anchor is a pair of holes in the housing through which the line passes or a pin around which the line passes.

5. The rocker mechanism for a baby seat of claim 1, wherein the projection rotates with respect to the rotatable member.

6. The rocker mechanism for a baby seat of claim 1, further comprising:

a baby seat configured connected to the second end of the line, wherein movement of the line causes the baby seat to rock.

7. A method of rocking a baby seat, comprising:

attaching a first end of a line to a first stationary anchor;

wrapping a portion of the line around a projection;

passing a mid-portion of the line through or around a second stationary anchor;

attaching a second end of the line to a baby seat; and rotating the projection in a circular path, thereby causing the second end of the line to move repeatedly towards and away from a housing, thereby causing the baby seat to rock.

8. The method of claim 7, wherein rotating the projection in a circular path comprises using a power source for rotating a rotatable member, wherein the projection is extends from the rotatable member.

* * * * *